United States Patent [19]

Champlin

[11] Patent Number: 4,549,650

[45] Date of Patent: Oct. 29, 1985

[54] ARTICLE CARRIER

[75] Inventor: Charles L. Champlin, Rittman, Ohio

[73] Assignee: Packaging Corporation of America, Evanston, Ill.

[21] Appl. No.: 570,170

[22] Filed: Jan. 12, 1984

[51] Int. Cl.[4] ..... B65D 77/04

[52] U.S. Cl. ..... 206/179; 206/178; 206/198; 229/28 BC; 229/29 C; 229/52 BC

[58] Field of Search ..... 206/139, 162, 167, 169, 206/172, 173, 174, 175, 176, 178, 179, 180, 184, 187, 189, 190, 191, 193, 198, 200, 427, 429, 435; 229/15, 28 BC, 29 B, 29 C, 52 BC

[56] References Cited

U.S. PATENT DOCUMENTS

| | | | |
|---|---|---|---|
| 2,576,179 | 11/1951 | Holy | 206/162 |
| 2,652,968 | 9/1953 | Bolding | 206/176 |
| 2,773,625 | 12/1956 | Arneson | 206/184 |
| 2,811,279 | 10/1957 | Arneson | 206/187 |
| 2,906,431 | 9/1959 | Kates | 206/162 |
| 2,919,050 | 12/1959 | Arneson | 206/187 |
| 2,983,406 | 5/1961 | Arneson | 206/172 |
| 3,456,841 | 7/1969 | Mahon et al. | 206/187 |
| 3,625,412 | 12/1971 | Rosenburg, Jr. | 229/39 |
| 4,240,546 | 12/1980 | Stone | 206/193 |
| 4,324,328 | 4/1982 | Champlin | 229/28 BC |
| 4,396,116 | 8/1983 | Stone | 229/28 BC |
| 4,418,818 | 12/1983 | Stone | 229/28 BC |

FOREIGN PATENT DOCUMENTS

| | | | |
|---|---|---|---|
| 0687381 | 3/1965 | Italy | 206/193 |

*Primary Examiner*—George E. Lowrance
*Assistant Examiner*—Jimmy G. Foster
*Attorney, Agent, or Firm*—Neuman, Williams, Anderson & Olson

[57] ABSTRACT

An article carrier is provided which is adapted to assume either a collapsed or set up mode. When in the set up mode, the carrier is adapted to accommodate a plurality of articles arranged in a pair of coextensive, substantially parallel rows. The set up carrier comprises a pair of upright end panels disposed at opposite ends of the article rows. Each end panel includes an upper section and a lower section which are interconnected by a horizontally extending foldline. The upper section of each end panel includes a substantially triangular center segment having an upwardly extending apex and a pair of substantially triangular shoulder segments foldably connected to the sides of the center segment defining the apex. A hand-gripping unit spans the distance between the end panels and is provided with a pair of depending panel sections having the upper peripheral portions thereof interconnected by a foldline which terminates at each end at the apex of the end panel center segment. The side peripheral portions of each panel section are foldably connected to a corresponding shoulder segment of an end panel. The hand-gripping unit is subtended by a base panel having a first pair of opposed peripheral portions foldably connected to lower peripheral portions of the end panels. Side panels are foldably connected to a second pair of opposed peripheral portions of the base panel and coact therewith and with the end panels to form an open top chamber. A partition member coacts with the depending panel sections of the hand-gripping unit to form the chamber into two compartments disposed on opposite sides of the depending panel sections and with each compartment having at least three article-accommodating cells.

11 Claims, 13 Drawing Figures

FIG. 4
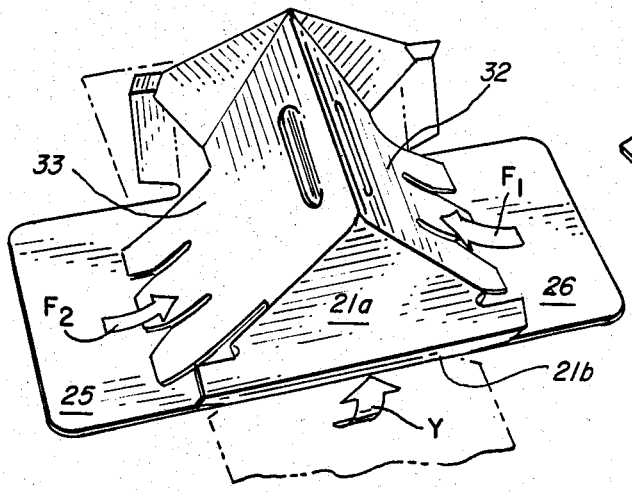
FIG. 9
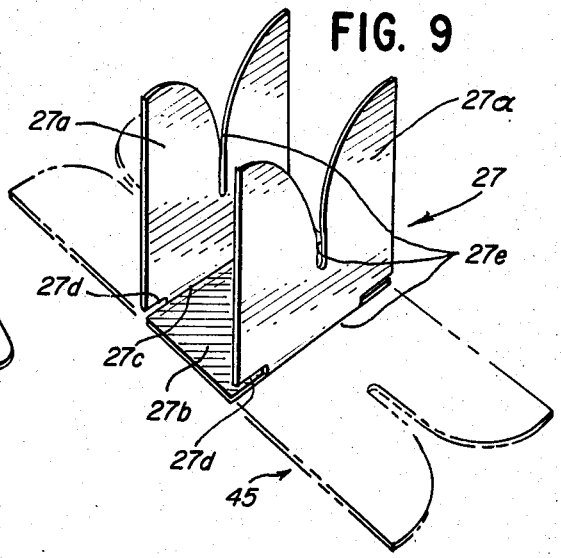
FIG. 5
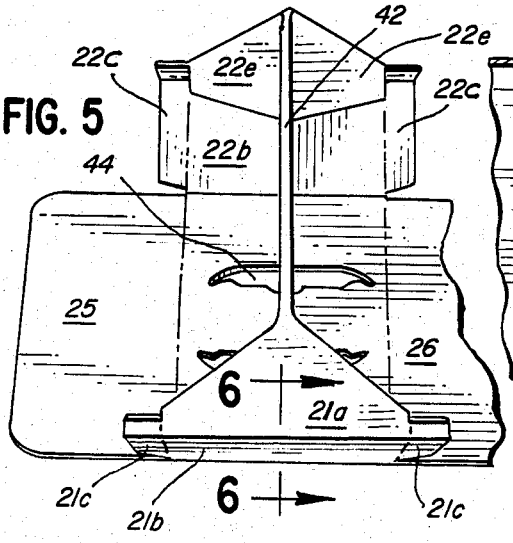
FIG. 6
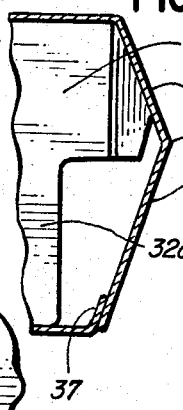
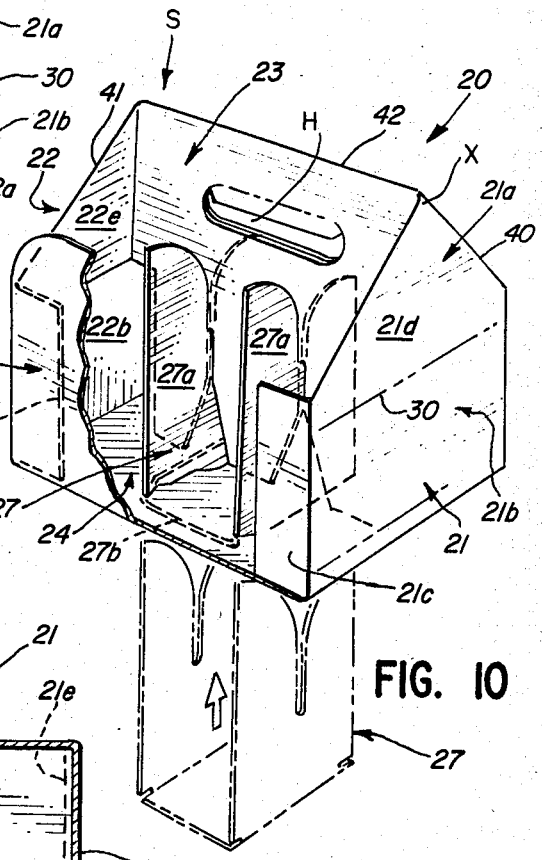
FIG. 10
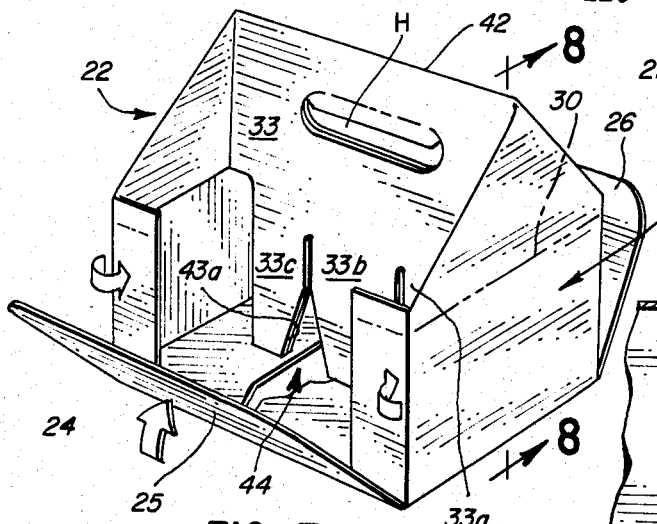
FIG. 7
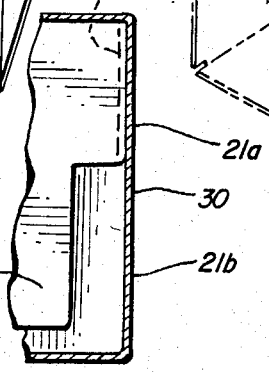
FIG. 8

ARTICLE CARRIER

BACKGROUND OF THE INVENTION

In the retailing of various beverages it has become increasingly popular for the beverages to be contained in returnable 8, 12, or 16 ounce bottles. A predetermined number (e.g. six) of the filled bottles are initially packaged in a carrier formed of suitable paperboard material. Once the bottles are empty they are normally returned to the place of purchase for a refund of the bottle deposit charged at the time of purchase. To facilitate the return of the empty bottles, it is desirable to utilize, if possible, the initial carrier for this purpose.

Various dual purpose carriers have heretofore been proposed; however, because of certain inherent design characteristics they have been beset with one or more of the following shortcomings: (a) the carrier had a complex configuration and was difficult to set up and load; (b) the carrier failed to provide adequate protection for the accommodated bottles; (c) the carrier, when loaded, was awkward and uncomfortable to manually carry; (d) the carrier required an inordinate amount of paperboard material; (e) the carrier had an unattractive appearance and loaded carriers could not readily be arranged in stacked relation for display or storage purposes; and (f) the carrier, when not set up, could not be stored or transported to the bottler while in a collapsed state.

SUMMARY OF THE INVENTION

Thus, it is an object of the invention to provide an article carrier which readily avoids the shortcomings aforenoted.

It is a further object to provide an improved article carrier which may be readily set up by high speed, automatic or semi-automatic equipment.

It is a still further object to provide an improved article carrier which is of simple, inexpensive construction and yet is strong and capable of withstanding rough treatment normally encountered in handling carriers of this general type.

It is a still further object to provide an improved article carrier which is capable of accommodating bottles and/or containers which vary in size and shape over a wide range.

Further and additional objects will appear from the description, accompanying drawings, and appended claims.

In accordance with one embodiment of the invention, an article carrier is provided which is formed of foldable sheet material and is adapted to assume either a collapsed or set up mode. When in a set up mode, the carrier is adapted to accommodate a plurality of articles arranged in a pair of substantially parallel, coextensive rows. The set up carrier is provided with a pair of upright end panels arranged in spaced, opposed, substantially parallel relation and disposed adjacent opposite ends of the article rows. Each end panel has an upper section and a lower section which are interconnected by a transversely extending first foldline. The upper section has a substantially triangularly shaped center segment with an upwardly extending apex. The peripheral side of the center segment opposite the apex is defined by the first foldline. The upper section of the end panel is also provided with a pair of triangularly shaped shoulder segments which are connected by second foldlines to the peripheral sides of the center segment defining the apex. A hand-gripping unit spans the distance between the upright end panels. A base panel subtends and supports the article rows and has opposed first peripheral portions connected by third foldlines to the corresponding lower peripheral portions of the end panels. Upright side panels are connected by fourth foldlines to opposed second peripheral portions of the base panel. The end, base, and side panels coact to form an open top chamber. Means coact with the hand-gripping unit to effect partitioning of the chamber into two contiguous compartments with each compartment having at least three article-accommodating cells. The hand-gripping unit is provided with a pair of elongated upright panel sections, each of which spans the distance between the end panels and is disposed substantially perpendicular thereto. Upper peripheral portions of the panel sections are interconnected by a fifth foldline, the ends of which terminate at the apexes of the end panel upper sections. Peripheral side portions of the panel sections are connected by sixth foldlines to corresponding shoulder segments of the end panel upper sections. Each shoulder segment is disposed in face-to-face relation with the interior surface of the end panel center segment to which it is foldably connected.

DESCRIPTION

For a more complete understanding of the invention, reference should be made to the drawings wherein:

FIG. 4 is a perspective top view of the carrier of FIG. 2 during an intermediate stage of set-up.

FIG. 5 is a fragmentary perspective top view of the partially set up carrier with the hand-gripping unit thereof fully set up.

FIG. 6 is an enlarged fragmentary sectional view taken along section line 6—6 of FIG. 5.

FIG. 7 is a corner perspective view of the carrier of FIG. 5 in a final stage of set-up.

FIG. 8 is an enlarged fragmentary sectional view taken along section line 8—8 of FIG. 7.

FIG. 9 is an enlarged perspective top view of one form of an insert piece per se; the blank therefor being shown in phantom lines. FIG. 10 is a perspective corner view of the carrier in a fully set up mode and showing in phantom lines the insert piece of FIG. 9 aligned with the base panel prior to portions of the piece being inserted through slots in the base panel into interlocking relation with the panel sections of the hand-gripping unit; portions of one side panel being removed so as to reveal the interior of one of the compartments.

Figure 11:
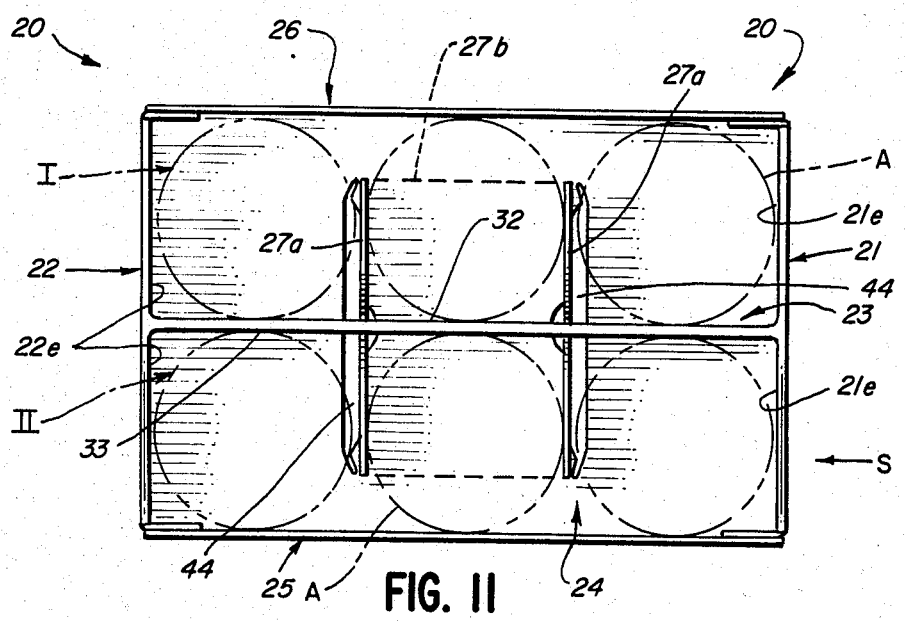

FIG. 11 is a top view of the carrier of FIG. 10 and showing in phantom lines rows of articles accommodated therein.

Figure 12:
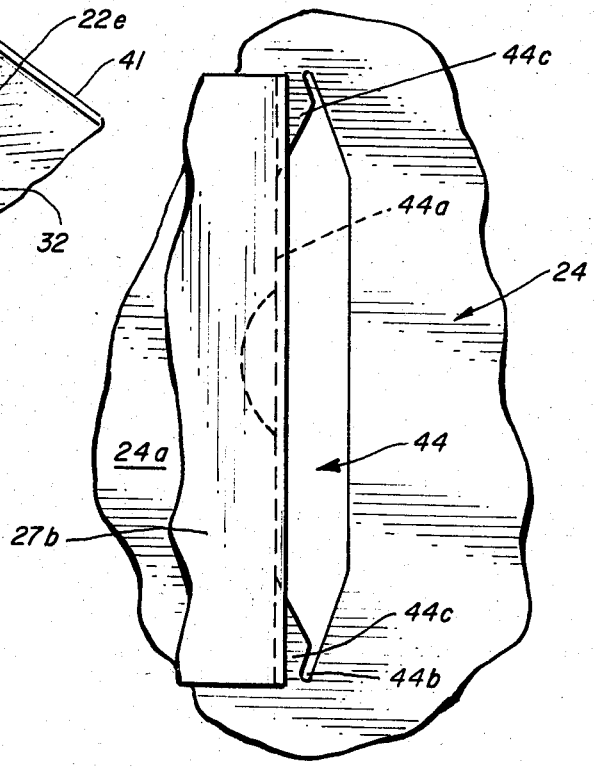

FIG. 12 is an enlarged fragmentary bottom view of the carrier of FIG. 10 and showing the interlocking relation between a portion of the insert piece and one of the slots formed in the base panel of the carrier.

Figure 13:
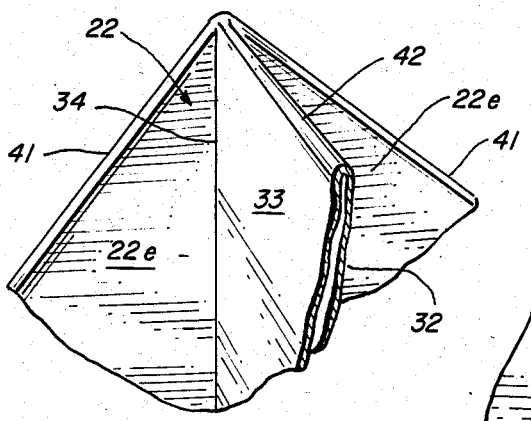

FIG. 13 is an enlarged fragmentary perspective view of the folding connection between the panel sections of the hand-gripping unit and the shoulder segments of one end panel of the improved carrier when the latter is fully set up.

Referring now to the drawings and more particularly to FIGS. 10–11, one embodiment of the improved carrier 20 is shown which is adapted to accommodate two rows I, II of articles A (e.g. returnable beverage bottles) arranged in parallel coextensive relation. Each row consists of three articles arranged in side-by-side relation, see FIG. 11. The improved carrier is intended to function as the original package for the filled bottles, and also as a convenient means for returning the empty bottles to the place of purchase for a refund of the bottle deposit originally made by the customer. Because of the dual function performed by the improved carrier, it is necessary that it be possessed of certain inherent characteristics: (a) it must provide effective protection against the accommodated bottles striking one another and breaking when the loaded carrier is subjected to normal handling; (b) the carrier must be easily loaded and unloaded; (c) the loaded carrier must be comfortable and easy to carry with one hand; (d) the loaded carrier must be capable of being stacked with other loaded carriers of similar design; and (e) the carrier must be easily set up or collapsed when desired. The improved carrier 20 hereinafter described readily meets these criteria. In addition, the carrier is formed of inexpensive paperboard material, is attractive in appearance, and is capable of being set up and loaded utilizing high speed equipment.

The improved carrier 20 is of a basket-type and includes a pair of opposed upright end panels 21, 22; a hand-gripping unit 23 foldably connected to the end panels and spanning the distance therebetween; a base panel 24 subtending the hand-gripping unit; opposed upright side panels 25, 26; and an insert piece 27 which coacts with the base panel and portions of the hand-gripping unit to form the carrier interior into a plurality of individual bottle-accommodating cells.

Figure 1:
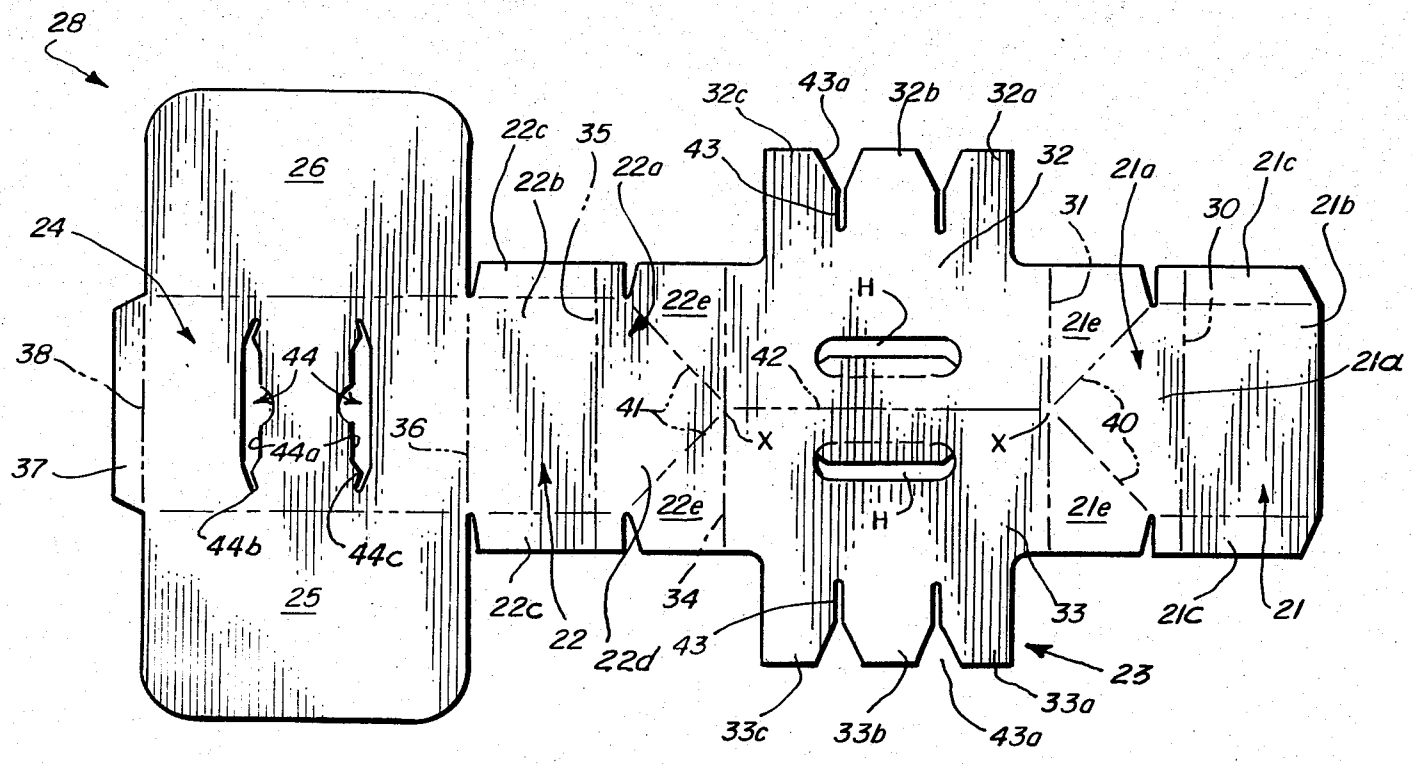
FIG. 1 is a plan view of the blank for one embodiment of the improved article carrier.
Figure 2:
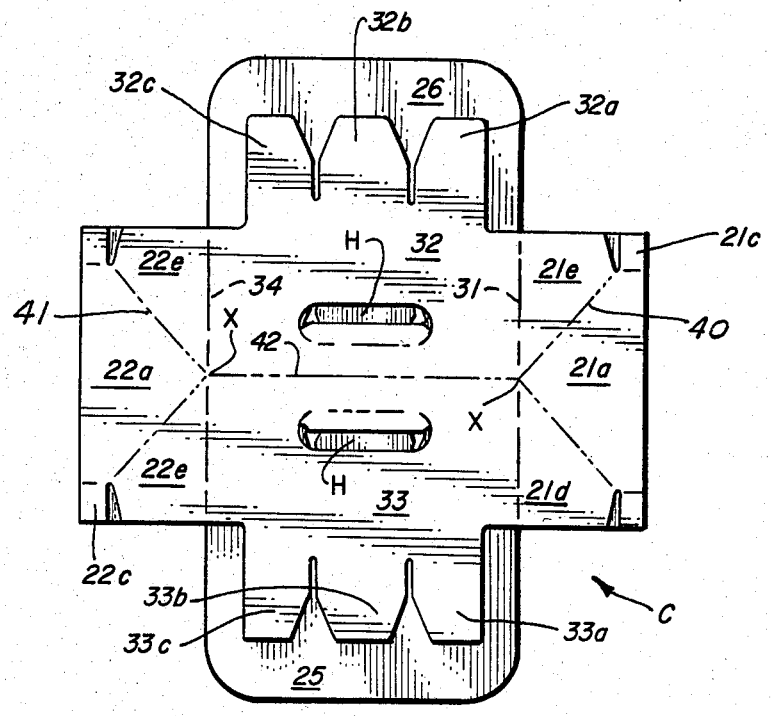
FIGS. 2 and 3 are top and bottom views, respectively, of the one embodiment of improved article carrier when in a collapsed mode.
Figure 3:
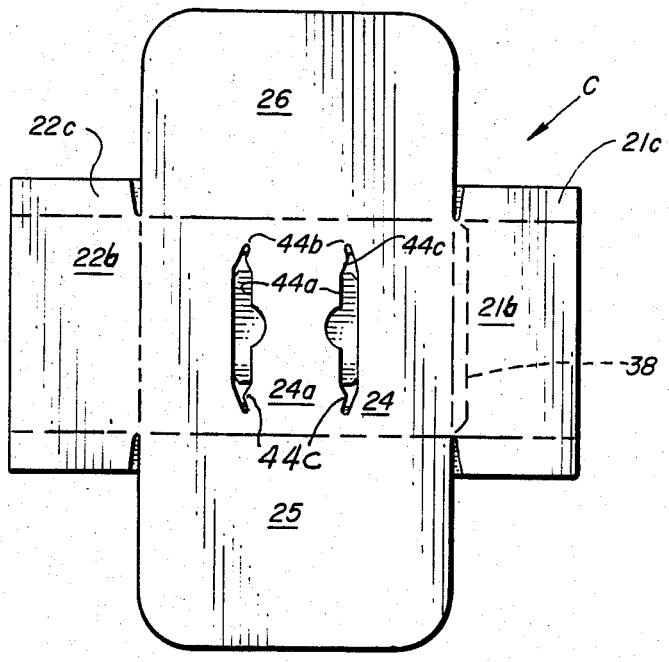

Carrier 20 is capable of assuming either a set-up mode S, FIGS. 10–11, or a collapsed mode C, FIGS. 2–3. When in a collapsed mode C, the carrier is suitable for bulk shipment to or storage by the customer (e.g. bottler). FIG. 1 illustrates a blank 28 of suitable paperboard material having at least one finished surface capable of having decorative graphics or indicia applied thereto. Starting at the right hand side of the blank, as viewed in FIG. 1, there is provided one end panel 21 having an upper section 21*a* and a lower section 21*b* which are interconnected to one another by a transversely extending foldline 30. The upper section 21*a* is also connected by a transversely extending foldline 31 to corresponding side edges of a pair of panel sections 32, 33, the latter comprising components of the hand-gripping unit 23, as will be described more fully hereinafter. The corresponding opposite side edges of the panel sections 32, 33 are connected by a transversely extending foldline 34 to the upper section 22*a* of the other end panel 22. End panels 21, 22 in the illustrated embodiment are of like configuration. The lower section 22*b* of end panel 22 is connected to the upper section 22*a* by a transversely extending foldline 35. The bottom edge of end panel 22 is connected to an end edge of the base panel 24 by a transversely extending foldline 36. The opposite end edge of the base panel is connected to a conventional manufacturer's glue flap 37 by a foldline 38. Foldlines 30, 31, 34, 35, 36, and 38 are disposed in spaced parallel relation. Both end panels 21, 22 are provided with foldable side flaps 21C, 22C to which the side panels 25, 26 are adhesively secured and retained upright, when the carrier is in the set-up mode S.

The upper section of each end panel includes a center segment 21*d*, 22*d* which has a substantially triangular configuration with one apex X of the triangle extending upwardly, see FIG. 10. Connected by foldlines 40, 41 to the converging sides of the center segments 21*a*, 22*a* are substantially triangular shoulder segments 21*e*, 22*e*. One side of each shoulder segment 21*e* is defined by foldline 31 and a corresponding one side of each shoulder segment 22*e* is defined by foldline 34, see FIG. 1.

Panel sections 32, 33 of the hand-gripping unit 23 have the corresponding upper edges thereof connected by a foldline 42. The ends of foldline 42 terminate at the apexes X formed in the end panel center segments 21*d*, 22*d*. Each panel section 32, 33 is of like configuration and has the lower edge provided with depending finger-like projections 32*a*, 32*b*, 32*c*, and 33*a*, 33*b*, 33*c*. Adjacent projections are separated by an elongated slot 43. An open end 43*a* of each slot, which is the lower end when the carrier is set up, is flared for reasons which will become apparent hereinafter. In addition to the slots 43, each panel section is provided with an elongated hand hole H of conventional design which has a longitudinal axis that is in spaced substantially parallel relation with foldline 42.

Base panel 24 is provided with a pair of spaced, substantially parallel, elongated slots 44 which extend transversely of the base panel and are disposed substantially perpendicular to the side panels 25, 26 when the carrier is in the set up mode S. Corresponding adjacent perimetric segments 44*a* of the slots 44 are in substantial vertical alignment with the longitudinal centerlines of the corresponding slots formed in the panel sections 32, 33. As noted in FIGS. 3 and 12, the ends 44*b* of each slot 44 is narrowed and offset a slight amount so as to form laterally extending protuberances 44*c*. The purpose of these protuberances will become apparent hereinafter.

The slots 44 formed in base panel 24 are adapted to accommodate the upright leg sections 27*a* of the U-shaped piece 27 when the carrier 20 is in the set up mode S, see FIGS. 10–11. The insert piece, as seen in FIG. 9, is formed from a blank 45 (shown in phantom lines) of the same paperboard material utilized in forming blank 28. Blank 45 is elongated and has a width corresponding substantially to the longitudinal (length) dimension of one of the slots 44 formed in the base panel 24. Blank 45 is formed into three sections. The end sections, forming the upright legs 27*a* of the U-shaped insert piece, are separated by and foldably connected to a center bail section 27*b*. When the insert piece 27 is properly assembled with the base panel 24, the center section 27*b* will be exposed and subtend the portion 24*a* of the base panel disposed between the slots 44. Foldlines 27*c* connect the leg sections 27*a* to the center section 27*b*. As will be noted in FIG. 9, the opposite ends of each foldline 27*c* terminate in small notches 27*d* which are adapted to accommodate the protuberances 44*c* of the base panel slots 44 and, thus, effect interlocking of the insert piece and the base panel.

The upper end of each leg section 27*a* is provided with a central depending slot or groove 27*e* which has a flared upper open end. The flared ends of the leg section slots 27*e* and the flared ends of the panel section slots 43 facilitate inserting the piece 27 into the carrier interior whereby the slots 27*e* and 43 will coact with one another so that the panel sections and the leg sections interlock in a right angle relationship and form three bottle-accommodating cells on each side of the hand-gripping unit 23.

To form the carrier 20, blank 28 is initially folded as follows: (a) base panel 24 and the associated side panels 25, 26 and the manufacturer's glue flap 38 are folded as a unit about foldline 36 so as to overlie end panel 22 and portions of panel sections 32, 33; (b) end panel 21 and associated flaps 21*c* are folded as a unit about foldline 31 so that the lower edge portion of end panel 21 will overlie and be adhesively secured to the coated surface of flap 38; and (c) the end panels 21, 22 are then folded along their respective foldline 30, 35 so that the upper and lower sections of each end panel are in face to face relation and the base panel and associated side panels overlie the panel sections 32, 33, see FIG. 3. When blank 28 is in the folded condition shown in FIGS. 2–3, the carrier is in the collapsed mode C and is suitable for bulk shipping or storage.

When the carrier is to be erected from the collapsed mode C to the set up mode S, the collapsed carrier is positioned on a supporting surface with panel sections 32, 33 exposed and facing upwardly, see FIG. 2. Inwardly and upwardly opposing forces $F_1$, $F_2$ are simultaneously applied to the slotted edge portions of the panel sections 32, 33 in the directions shown by the arrows in FIG. 4. Because the side edges of the panel sections 32, 33 are foldably connected to the shoulder segments 21*e*, 22*e* of the end panels 21, 22, the latter will automatically move in the directions of arrows Y, only one being shown in FIG. 4, to upright positions as shown in FIGS. 5 and 7. It will be noted in FIG. 4, that as forces $F_1$, $F_2$ are simultaneously applied to the panel sections 32, 33, the latter will fold relative to one another about foldline 42 until the sections assume a face-to-face relation, see FIGS. 5 and 13. As the panel sections 32, 33 approach their face-to-face relation, the shoulder segments 21*e*, 22*e* which are foldably connected to the side edges of the panel sections, will automatically fold inwardly and downwardly about foldlines 40, 41 into overlapping relation with the opposed interior surfaces of end panels 21, 22. As seen in FIG. 11, panel sections 32, 33 are in substantially contacting face-to-face relation throughout and define a center partition which is perpendicular to the upright end panels 21, 22.

The fingerlike projections 32*a–c*, 33*a–c* of the panel sections 32, 33 are disposed in contact with or in close proximity to the base panel 24 when the carrier is in the set up mode S. As seen in FIG. 7, the flared ends 43*a* of the panel section slots 43 are vertically aligned with the base panel slots 44. Because of the ends of slots 43 being flared the free ends of the leg sections 27*a* of the insert piece are readily guided into interlocking relation with the vertically disposed panel sections.

Once the panel sections 32, 33 are in face-to-face relation, the side flaps 21*c*, 22*c* of the upright end panels are folded towards one another and then the side panels 25, 26 are folded to upright positions and adhesively secured to the folded flaps 21*c*, 22*c*. Thus, side panels 25, 26, end panels 21, 22, and base panel 24 coact with one another to form a chamber having an open top. The carrier is loaded and unloaded through the open top. The panel sections 32, 33 effect separation between the rows of bottles I, II and the leg sections 27*a* of the insert piece 27 effect separation of the adjacent bottles in a row. By having the ends of the foldline 42 between the panel sections, extend to the apexes of the end panel center segments, there is no obstruction created which would interfere with the loading and unloading of the endmost cells. Furthermore, by having the panel sections in face-to-face contact throughout and spanning the distance between the end panels 21, 22, the hand-gripping unit is possessed of superior strength.

I claim:

1. An article carrier formed from a blank of foldable sheet material and adapted to assume either a collapsed or setup mode, and when in a setup mode being adapted to accommodate a plurality of articles arranged in a pair of substantially parallel, coextensive rows, said setup carrier comprising a base panel for subtending and supporting the article rows; a pair of end panels arranged in spaced, opposed, substantially parallel, upright relation for disposition adjacent opposite ends of the article rows, said end panels being foldably connected to opposed first peripheral portions of said base panel, the upper portion of each end panel including a tapered center segment having an upwardly extending, centrally located apex, and a pair of substantially triangular shoulder segments foldably connected to tapering sides of said center segment defining said apex, each shoulder segment having an upwardly extending apex contiguous to said center segment apex; a pair of side panels arranged in substantially parallel, upright relation for disposition adjacent corresponding article rows, said side panels being foldably connected to remaining peripheral portions of said base panel and being connected to said end panels and coacting therewith to delimit the periphery of said base panel and to form an open top chamber; and a hand-gripping unit spanning the distance between said upright end panels and being foldably connected thereto, said hand-gripping unit including a pair of elongated upright panel sections arranged in substantially face-to-face parallel relation throughout and forming a thin partition of substantially uniform thickness and having a lower peripheral portion proximate said base panel, said partition being disposed substantially perpendicular to said base panel and spanning the distance between said end panels and coacting with said end and side panels to form the open top chamber into a pair of contiguous elongated compartments arranged in side by side relation, each compartment being adapted to accommodate a row of articles.

2. An article carrier formed from a blank of foldable sheet material and adapted to assume either a collapsed or set-up mode, and when in a set up mode being adapted to be top-loaded and top-unloaded and to accommodate a plurality of articles arranged in a pair of substantially parallel co-extensive rows, said set-up carrier comprising a pair of end panels arranged in spaced, opposed, substantially parallel upright relation for disposition adjacent opposite ends of the article rows, each end panel having an upper section and a lower section interconnected by a transversely extending first foldline, the upper section including a substantially triangularly shaped center segment having an upwardly extending apex and a side opposite thereto defined by said first foldline, and a pair of substantially triangularly shaped shoulder segments connected by second foldlines to the sides of said center segment defining said apex, each shoulder segment having an upwardly extending apex contiguous to the center segment apex; a hand-gripping unit spanning the distance between said upright end panels; a base panel for supporting and subtending the article rows and having opposed first peripheral portions connected by third foldlines to lower peripheral portions of said end panels; said first and third foldlines being in spaced substantially parallel relation; and upright side panels connected by fourth foldlines to opposed second peripheral portions of said base panel for disposition adjacent corresponding article rows and being secured to and coacting with said end panels to delimit the periphery of said base panel and to form a chamber having an open top; said hand-gripping unit including a pair of elongated upright panel sections arranged in substantially face-to-face parallel relation throughout and forming a thin partition of substantially uniform thickness and having a lower peripheral portion proximate said base panel, said partition spanning the distance between and being disposed substantially perpendicular to said upright end panels and forming said chamber into two contiguous elongated compartments, each adapted to accommodate an article row, corresponding upper peripheral portions of said panel sections being connected by a fifth foldline having the ends thereof terminating at the upwardly extending apexes of said end panel center segments and said shoulder segments, side peripheral portions of said panel sections being connected by sixth foldlines to corresponding shoulder segments of said end panel upper sections, said shoulder segments being disposed substantially perpendicular to said panel sections and in substantially face-to-face relation with interior surfaces of corresponding upper sections of the upright end panels, the second and sixth foldlines defining two side edges of each shoulder segment intersecting one another at the upwardly extending apex of the center segment of the end panel to which said shoulder segment is connected.

3. The article carrier of claim 2 wherein the base panel of the set-up carrier is provided with a plurality of elongated slots arranged in spaced substantially parallel relation and disposed substantially perpendicular to said upright side panels, the lower peripheral portions of the upright panel sections of the hand-gripping unit being provided with upwardly extending slots open at the lower ends thereof, corresponding slots in said base panel and said panel sections being in aligned relation; said aligned slots interlockingly accommodating one upright leg portion of a U-shaped insert member, the leg portions of said U-shaped insert member coacting with the partition of the hand-gripping unit to form a plurality of article-accommodating cells in each compartment.

4. The article carrier of claim 3 wherein the upper peripheral portions of the upright leg portions of the U-shaped member are provided with downwardly extending slots open at the upper ends thereof, each downwardly extending slot interlockingly engaging corresponding slots formed in the panel sections of said hand-gripping unit.

5. The article carrier of claim 4 wherein each base panel slot has a center portion and end portions, corresponding end portions of the base panel slots extending in a predetermined convergent relation from the slot center portions whereby an offset protuberance is formed adjacent each end portion; the upright leg portions of the U-shaped insert member have lower peripheral portions thereof foldably connected to a bail portion, the latter being in face-to-face contact with an exterior portion of the base panel disposed between the pair of slots formed therein, the ends of the folding connection between the leg and bail portions terminating in notches, the latter lockingly accommodating corresponding offset protuberances formed in base panel slots.

6. The article carrier of claim 5, wherein each slot formed in the panel sections is disposed in substantially vertical alignment with the midlength of a corresponding base panel slot.

7. The article carrier of claim 5 wherein the center portion of each base panel slot is relatively wide as compared to the end portions.

8. The article carrier of claim 4 wherein the open ends of the panel section slots and the leg portion slots are flared.

9. A blank of foldable sheet material for forming a basket-type article carrier adapted to accommodate a plurality of articles arranged in a pair of substantially parallel, coextensive rows, said blank comprising a base panel for subtending and supporting the rows of articles; side panels foldably connected to opposed first peripheral segments of said base panel; a first end panel having a lower edge foldably connected to a second peripheral segment of said base panel, said second segment being substantially transverse to said first segments; a hand-gripping unit foldably connected to an upper edge of said first end panel; and a second end panel having an upper edge foldably connected to an edge of said hand gripping unit opposite said first end panel; each end panel being of substantially like configuration and having an upper section including a substantially triangular center segment with an apex thereof adjacent said hand-gripping unit, and a pair of substantially triangular shoulder segments having corresponding first sides thereof foldably connected to sides of said center segment defining said apex, each shoulder segment having an apex contiguous to the apex of the center segment to which said shoulder segment is connected; said hand-gripping unit including a pair of panel sections having corresponding upper edges thereof connected by a common foldline, opposite ends of the common foldline terminating at the corresponding apexes of the center and shoulder segments of said end panels, opposed side edges of each panel section being foldably connected to corresponding second sides of the shoulder segments of said end panels, the length of each folding connection between a panel section side edge and a second side of the corresponding shoulder segment being at least one half the dimension between the center segment apex and a corresponding second peripheral segment of said base panel, the first and second sides of each shoulder segment intersecting one another to form the apex contiguous to the apex of a center segment of one end panel; when said blank is set up to form said article carrier, the panel sections of said hand-gripping unit being disposed in substantially contacting face-to-face relation and defining a thin partition disposed substantially perpendicular to said base and end panels, and the shoulder segments of said end panels being disposed in face-to-face relation to the interior surface of the center segment to which they are connected.

10. The blank of claim 9 wherein the base panel is provided with a pair of spaced, substantially parallel slots extending substantially transversely of the folding connections between said base panel and said side panels; each slot having narrow offset end portions whereby lateral protuberances are formed in said slot adjacent said end portions, the protuberances of said base panel slots being adapted to interlockingly engage leg sections of a U-shaped insert piece when the leg sections of the latter are inserted through the slots into engagement with the panel sections of the hand-gripping unit.

11. The blank of claim 10 wherein the peripheral portion of each panel section opposite the upper edge thereof is provided with a pair of spaced slots having open ends adjacent to and in vertical alignment with the slots of said base panel, when said blank is set up to form the article carrier; said panel section slots being adapted to interlockingly accommodate the leg sections of the insert piece.

* * * * *